United States Patent [19]

Aerts et al.

[11] Patent Number: 4,738,605

[45] Date of Patent: Apr. 19, 1988

[54] INSTALLATION FOR MANUFACTURING REINFORCED CONCRETE ELEMENTS

[75] Inventors: Michel Aerts, La Babelone; Raymond Biancone, Le Pontet; Jean Eliche, Les Angles; Jean Richard, Althen Les Palu; Jean-Louis Tron, Morie es; Philippe Violle, Auignon, all of France

[73] Assignee: Societe Anonyme De Recherche Et D'Etudes Techniques, Le Pontet, France

[21] Appl. No.: 846,970

[22] Filed: Apr. 1, 1986

[30] Foreign Application Priority Data

Apr. 1, 1985 [FR] France ..... 85 04947

[51] Int. Cl.[4] ..... B28B 1/16; B28B 13/02

[52] U.S. Cl. ..... 425/98; 118/697; 249/155; 249/167; 249/172; 264/34; 264/228; 264/293; 364/475; 364/476; 364/479; 425/111; 425/140; 425/142; 425/145; 425/148; 425/258; 425/308; 425/375; 425/385; 425/DIG. 106

[58] Field of Search ..... 425/64, 88, 145, 159, 425/166, 171, 175, 182, 256, 258, 308, 289, 375, 385, 432, 453, 111, 98, 100, 140, 142, 148, DIG. 106; 249/155, 167, 172; 264/34, 228, 229, 297, 293, 333; 364/475, 476, 479; 318/578; 141/235, 243, 284; 118/696–698

[56] References Cited

U.S. PATENT DOCUMENTS

| | | | |
|---|---|---|---|
| 3,688,642 | 9/1972 | Negoro | 318/578 |
| 3,809,516 | 5/1974 | Komaki | 425/375 |
| 3,810,726 | 5/1974 | Bjorhaag | 425/111 |
| 4,125,195 | 11/1978 | Sasadi | 141/284 |
| 4,524,886 | 6/1985 | Wilson et al. | 364/479 |
| 4,564,410 | 1/1986 | Clitheros et al. | 364/474 |
| 4,584,964 | 4/1986 | Engel | 118/697 |
| 4,640,222 | 2/1987 | Gerber | 118/697 |

FOREIGN PATENT DOCUMENTS

| | | | |
|---|---|---|---|
| 1683786 | 3/1971 | Fed. Rep. of Germany . | |
| 2731230 | 6/1978 | Fed. Rep. of Germany . | |
| 2832295 | 1/1980 | Fed. Rep. of Germany . | |
| 2078954 | 10/1971 | France . | |
| 2437918 | 4/1980 | France . | |
| 493359 | 2/1976 | U.S.S.R. | 249/172 |

*Primary Examiner*—Jay H. Woo
*Assistant Examiner*—James C. Housel
*Attorney, Agent, or Firm*—Kane, Dalsimer, Sullivan, Kurucz, Levy, Eisele & Richard

[57] ABSTRACT

An installation for manufacturing reinforced concrete elements, in particular prestressed concrete slabs or pre-slabs, by means of a bench including a manufacturing area of predetermined shape, together with a molding apparatus. Memory means (46) are provided for storing building data relating to the elements to be manufactured and concerning at least the geometry thereof, together with tracing means (48) for marking on the manufacturing area (16) the locations of at least some of the walls placed thereon and constituting portions of the molding apparatus.

24 Claims, 10 Drawing Sheets

INSTALLATION FOR MANUFACTURING REINFORCED CONCRETE ELEMENTS

The present invention relates to an installation for manufacturing reinforced concrete elements, in particular prestressed concrete slabs or pre-slabs.

It relates in particular to such an installation comprising a bench having a manufacturing area of predetermined shape, together with molding apparatus suitable for defining a set of molds having a base formed by said manufacturing area and having vertical contours which are defined by walls placed on the manufacturing area.

BACKGROUND OF THE INVENTION

Installations of this nature are already known and they are used in particular for manufacturing elongate building elements, such as beams, posts, piles, etc. or plate-shaped building elements such as slabs or pre-slabs.

Pre-slabs are thin, generally planar elements of prestressed or reinforced concrete acting as non-reusable shuttering, which are used in particular when making floors. A pre-slab is placed in its final position in a building and is then covered with a layer of concrete which, after hardening, constitutes together with said pre-slab a strong slab of greater thickness.

At present, pre-slabs are manufactured either on site, or else they are prefabricated in a prestressed pre-slab factory.

When they are made on site, problems associated with the maximum size of load which can be transported by road are avoided, but the performance of the manufacturing process and any possibilities of rationalizing production remain limited.

When elements are made in a factory, they may be made to have large dimensions, in particular the elements may be at least 2.5 meters wide, thereby enabling wide spans to be covered.

Although such factory manufacture is theoretically suitable for automatic industrial manufacturing techniques, it turns out, in practice, that it is constrained by various special problems.

Such problems stem from the fact that each pre-slab constitutes a specific component part of a building and may differ from other pre-slabs in its dimensions, in its reinforcing rods, and in the inserts and spaces that need to be provided therethrough.

This problem is made even more difficult by the fact that the manufacturing area of an installation generally extends over a length of several tens of meters, for example, over 100 meters, and over a width which generally lies in the range 2.5 meters to 3 meters.

Thus, before casting the concrete, the locations of the pre-slabs on the manufacturing area need to be accurately delimited so that the sets of molds can be properly placed and with as little loss of room as possible on the manufacturing area.

One of the aims of the present invention is to improve the manufacture of prestressed or reinforced concrete elements, and in particular of prestressed concrete slabs or pre-slabs, by automating the various manufacturing steps as much as possible, and in particular by automating the tracing steps.

SUMMARY OF THE INVENTION

The present invention provides an installation for manufacturing reinforced concrete elements, in particular prestressed concrete slabs or pre-slabs, said installation making use of a bench including a manufacturing area of predetermined shape together with molding apparatus suitable for defining a set of molds whose bases are formed by the manufacturing area and whose vertical contours are defined by walls placed on said manufacturing area, the installation including the improvement of:

memory means suitable for storing building data relating to the elements to be manufactured and concerning at least the geometry thereof, said memory means storing data concerning elements which are to be manufactured together in order to fill the predetermined shape of the manufacturing area in a suitable manner; and tracing means for marking on the manufacturing area the locations of at least some of the walls placed thereon in such a manner as to completely define each mold in accordance with the corresponding data stored in the memory.

In a specific disposition of the invention, the set of molds comprises, in combination, edge rules constituting the outside longitudinal walls of the molds, together with intermediate rules and combs suitable for being disposed in directions which are respectively longitudinal and transversal relative to the bench in locations marked by the tracing means.

In another disposition in accordance with the invention, the molding apparatus further comprises distributor-vibrator means for distributing and vibrating the concrete in the molds, said means being controlled by the memory means.

In another disposition in accordance with the invention, the installation includes a corrugating carriage for corrugating the fresh concrete distributed by said concrete distributor-vibrator means, said carriage being displaceable along the bench and including a transverse beam of adjustable height having a multiplicity of flexible teeth depending therefrom, which teeth bear against a transverse stretcher.

In another disposition in accordance with the invention, the installation includes an automatic disk cutter for cutting the prestressed rods between elements obtained after the concrete has set, said cutter being transversly displaceable relative to a self-propelled carriage displaceable along the bench.

An installation in accordance with the invention is also applicable to manufacturing prestressed concrete elements including insulating plates on their underfaces.

In a first variant the invention includes means for maintaining longitudinal fastening bars on the bottom of the manufacturing area, which bars are subsequently used for fixing insulating plates by fastening means passing through the thickness of the plates and anchoring in said bars.

In a second variant the tracing means are suitable for tracing the contour of an insulating plate on a table situated beyond the manufacturing bench, and subsequently for placing glue at selected locations on an insulating plate placed on said table in accordance with said contour.

According to another aspect, the present invention provides a method for manufacturing reinforced concrete elements, in particular prestressed concrete slabs or pre-slabs, the method making use of a bench including a manufacturing area of predetermined shape together with molding apparatus suitable for defining a set of molds whose bases are formed by the manufacturing area and whose vertical contours are defined by walls placed on said manufacturing area, the method including the steps of:

storing building data relating to the elements to be manufactured in memory means, said stored building data concerning at least the geometry of said elements and bringing together data concerning elements which are to be manufactured together in order to fill the predetermined shape of the manufacturing area in a suitable manner;

marking on the manufacturing area the locations of at least some of the walls placed thereon in such a manner as to completely define each mold in accordance with the corresponding data stored in the memory;

installing the vertical contours of the molds; and casting concrete into the set of molds.

When manufacturing elements having prestressed reinforcement, the marking may take place either before the prestressing reinforcement is put into place, or else, and preferably, after the reinforcement has been put in place and put under tension.

In addition, the method provides for shearing the reinforcement in the gaps between the concrete elements after the concrete has hardened and the tension has been released therefrom, thereby enabling the manufactured elements to be lifted from the bench and stored for future use.

BRIEF DESCRIPTION OF THE DRAWINGS

Implementation of the invention are described by way of example with reference to the accompanying drawings, in which.

MORE DETAILED DESCRIPTION

Figure 1:
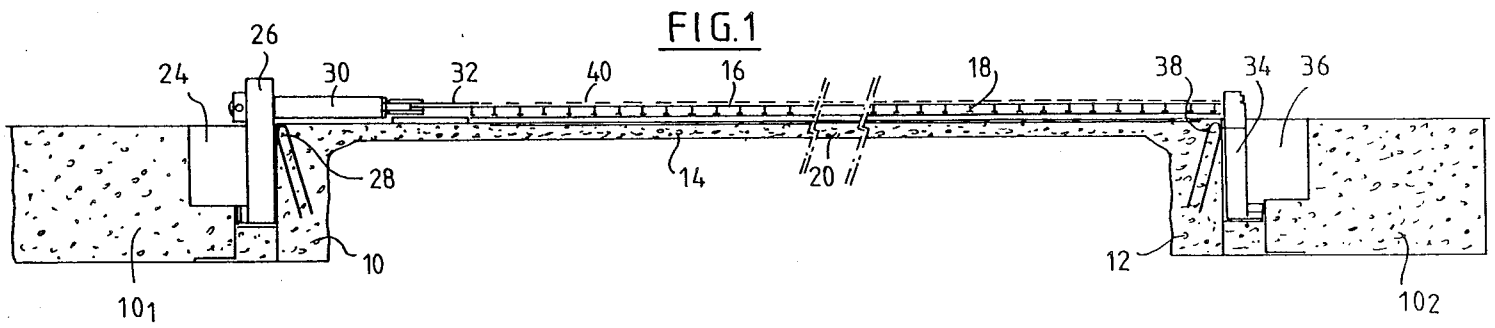
FIG. 1 is a longitudinal section through the bench of an installation in accordance with the invention.
Figure 2:
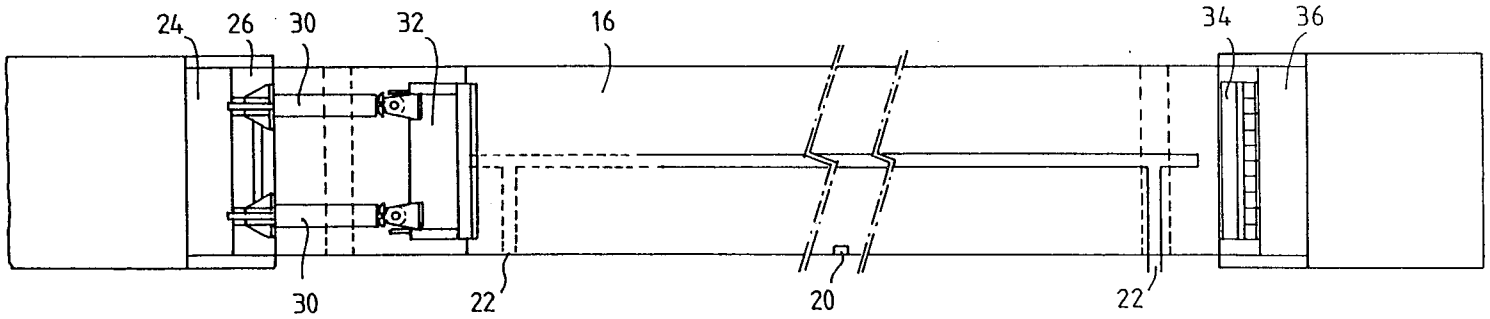
FIG. 2 is a plan view of the FIG. 1 bench.

The body of the bench shown in FIGS. 1 and 2 includes two buried end masses 10 and 12 made of reinforced concrete together with associated abutment masses $10_1$ and $10_2$. A ribbed slab 14 extends between these two masses, supports a manufacturing area 16, and compensates for the compression forces generated by the tension in the prestressed reinforcements used in manufacturing building elements.

The manufacturing area 16 comprises a deck constituted by a set of thick metal plates on which a series of I-section beams 18 extend parallel to one another and transversally to the length of the bench. These beams rest on the ribbed slab 14 via resilient studs (not shown).

The manufacturing area 16 defines a plane horizontal surface which is rectangular in shape with a length of about 100 meters and a width lying in the range 2.50 meters to 3 meters.

A heater device is disposed beneath the sheets constituting the manufacturing area 16 in order to accelerate the rate at which concrete sets after it has been cast on the manufacturing area. In the example shown, the heating is provided by steam and includes an inlet 20 and two outlets 22 for removing the condensate (the steam is not recycled).

The bench shown in FIGS. 1 and 2 also includes means for putting the prestressing reinforcements under tension and/or releasing them. A trench 24 provided behind the buried mass 10 receives vertical metal posts 26 which bear against a crossbeam 28. Two tensioning jacks 30 are hinged at one end to the posts 26 and at the other end to a traction bar 32.

A sealed anchor device is vertically inserted into a trench 36 provided behind the mass 12 at the other end of the bench. The device 34 bears against a crossbeam 38.

The above means serve to locate reinforcements 40 which are prestressed where they extend over the manufacturing area 16, with said reinforcements being constituted by parallel wires each having one end anchored in the device 34 and the other end anchored in the traction bar 32.

Advantageously, the bench also includes means for positioning the reinforcements 40. The set of reinforcing wires 40 is preferably provided in the form of a sheet which is prepared in advance and wound on a rotary drum mounted on a carriage which is displaceable along the bench. This makes it possible to begin by anchoring the entire sheet of wires in the traction bar 32 and subsequently to anchor the entire set of wires in the anchor device 34.

The main component parts of the bench as briefly outlined above, i.e. the body of the bench, the manufacturing area, the heater arrangements, the means for putting the reinforcing wires under tension or for releasing them, and the means for locating the reinforcing wires are known and do not form part of the present invention.

The structure and the operation of these prior art components is described, in particular in the applicant's French Pat. Nos. 72 31 148 and 79 07 427.

Figure 3:
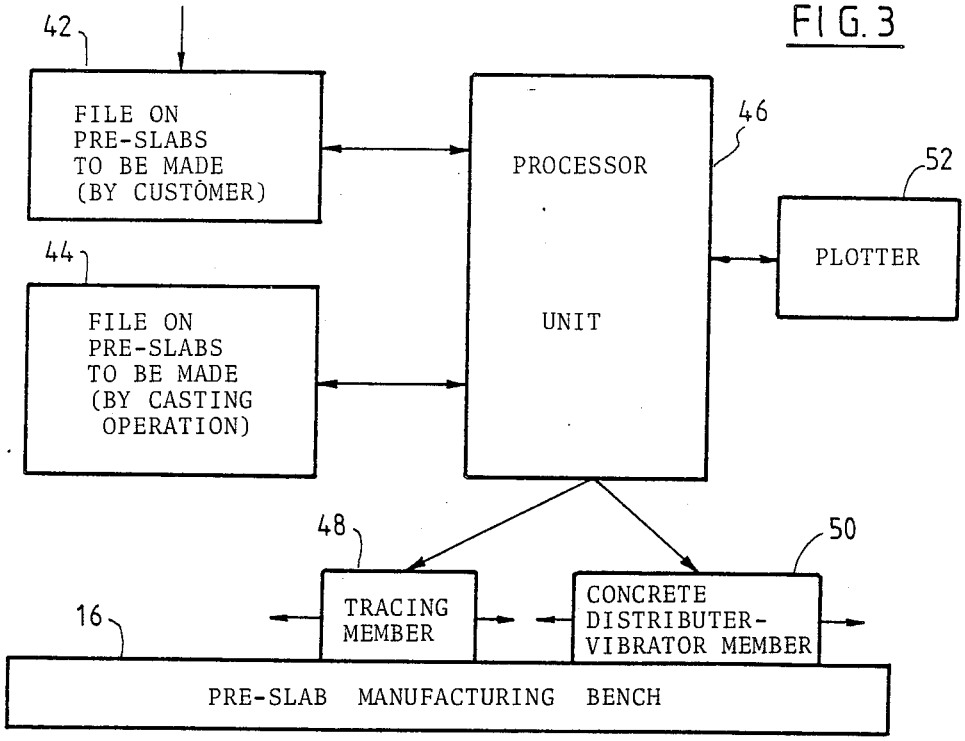
FIG. 3 is a block diagram showing how the tracing means and the concrete distributor-vibrator means are controlled by a processor unit.
Figure 4:
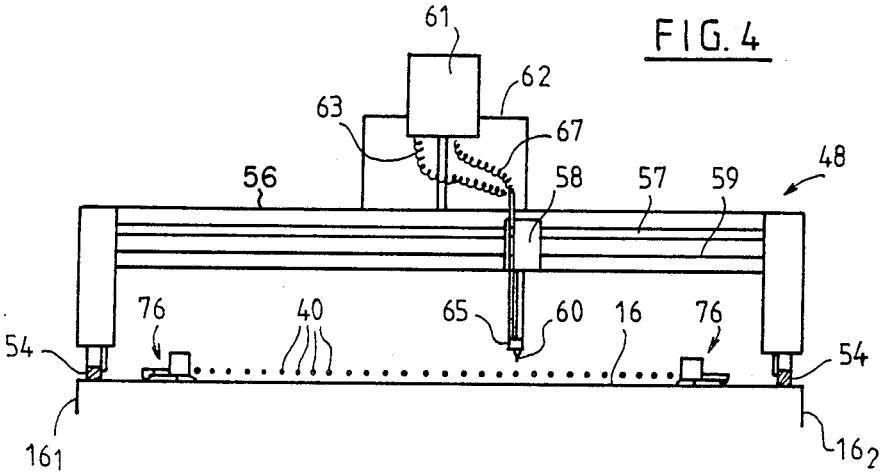
FIG. 4 is a front view of a tracing member of the installation.

Reference is now made to FIGS. 3 and 4 which relate more particularly to the tracing means in accordance with the invention.

The installation in accordance with the invention can be used to manufacture concrete elements which may be reinforced or prestressed, e.g. pre-slabs, on the manufacturing area 16, and as a function of building data relating to the elements to be manufactured. This data concerns at least the geometry of the elements, i.e. their shapes, their dimensions, and their thicknesses. The data may also include additional information, for example relating to the order in which the elements should be handled and in which they should be used on site.

This data is located in a file 42 which may relate for example, to the pre-slabs required by a given customer or by a given building site.

In addition, a file 44 is also provided containing data relating to the pre-slabs to be manufactured, with the slabs being grouped together by casting operation. This file also contains data concerning the dimensions of the manufacturing area in order to enable a set of slabs to be manufactured simultaneously on the manufacturing area in a single casting operation.

The files 42 and 44 may be produced, for example, using suitable software on Wang or similar equipment.

The data from the files 42 and 44 is applied to a processor unit 46 which includes memory means suitable for storing said data.

This processor unit may be constituted, for example, by Apple II or similar equipment. The processor unit 46 is connected to a tracing member 48 and to a concrete distributor-vibrator member 50 by means of suitable connections, e.g. by remote connections.

The processor unit 46 drives the tracing means 48 so that they mark on the manufacturing area 16 the locations of at least some of the walls which are subsequently placed on the manufacturing area and in such a manner as to completely define each mold in accordance with the corresponding data stored in the memory.

The processor unit 46 also drives the concrete distributor-vibrator member when subsequently distributing concrete in the molds, and as a function of the geometry of each mold.

It should be observed that the processor unit 46 may also be used to drive a plotter 52 in order to make plans of the pre-slabs on paper.

The processor unit 46 is arranged to set up the file 44 of elements which are to be manufactured in a single casting operation on the basis of the data in the raw file 42 of slabs to be manufactured and their respective shapes, taking account of the rectangular shape of the manufacturing area. In order to do this, any suitable known software capable of filling said shape may be used.

The tracing member 48 is shown in greater detail in FIG. 4. It comprises a self-propelled gantry capable of moving over the entire length of the bench on rails 54 which are disposed on either side of the manufacturing area 16, and which are fixed thereto. These rails are disposed in the immediate proximity of the edges $16_1$ and $16_2$ of the bench.

The gantry comprises a horizontal crossbeam 56, a nozzle-carrying carriage 58 which is movable along said beam by means of a shaft 57 extending parallel to the beam used in conjunction with a go-and-return cable 59. The gantry also includes a spray nozzle 60 carried by the carriage, and a programmable control unit 62 connected to the memory means of the processor unit 46. The nozzle 60 is connected via a flexible duct 63 to a tank 61 of tracing liquid carried by the carriage 48. This nozzle is associated with an electrically-controlled valve 65 connected to the control unit 62 by a flexible electrical connection 67.

The control unit 62 may be of the type sold by Merlin-Gerin, and is suitable for controlling the displacement of the gantry along the rails 54 and the displacement of the carriage 58 along the beam 56, together with the on/off operation of the electrically-controlled valve 65 which controls the nozzle 60.

The nozzle 60 is thus displaceable in accordance with a system of orthogonal axes in order to mark the locations of at least a portion of the walls of a mold which is to be placed on the manufacturing area 16.

The above-mentioned tracing means are used to project a tracing liquid via the nozzle 60 towards the manufacturing area 16 over which the reinforcing wires 40 may already be prestressed.

The tracing member 48 is equally applicable before or after the reinforcing wires 40 have been put into place.

The liquid sprayed by the tracing member 48 may be a mixture of white ceiling paint, water, and soluble oil. Such a mixture has the following advantages: it is cheap, it is easy to use (it flows under gravity), it does not dry in the paint mixture, it does not leave permanent marks either on the deck of the manufacturing area or on the bottom faces of the pre-slabs, and it leaves a narrow uniform line even when unmolding oil is present on the manufacturing area.

A white line may thus be obtained which is 3 to 5 mm wide, which is comfortably compatible with manufacturing tolerances.

Figure 5:
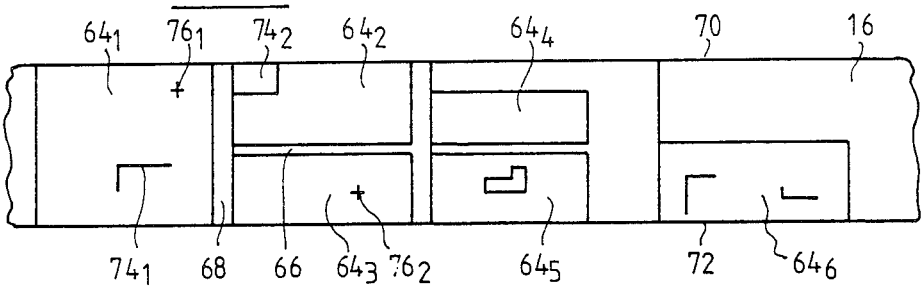
FIG. 5 shows examples of the marks traced on the manufacturing area of the installation.

As shown in FIG. 5, the tracing member 48 may be driven to mark, on the manufacturing area, the locations of at least a portion of the walls which are placed thereon in order to manufacture different pre-slabs. In this case, the following pre-slabs are to be made: a pre-slab 64, which extends over the entire width of the manufacturing area, two pre-slabs $64_2$ and $64_3$ of equal length disposed side by side across the width of the manufacturing area, two pre-slabs $64_4$ and $64_5$ of equal length, likewise disposed side by side on the manufacturing area, and a pre-slab $64_6$ of smaller width than the manufacturing area.

The line marks the location of at least a portion of the mold walls, namely the intermediate rules, e.g., at location 66, and the transverse combs, e.g., at location 68.

The tracing member 48 is not programmed to trace the longitudinal side edges 70 and 72 of the manufacturing area 16 since these edges are closed by rules as is described below with reference to FIGS. 6 and 7.

The invention also provides for the control unit 62 to be programmed to trace reference symbols for the locations of voids, e.g. $74_1$ and $74_2$, for electrical emplacements, e.g. $76_1$ and $76_2$, etc. It may be observed that the location of a rectangular void, e.g., $74_1$, need not be traced in full. Two adjacent sides of the rectangle are sufficient.

Figure 6:
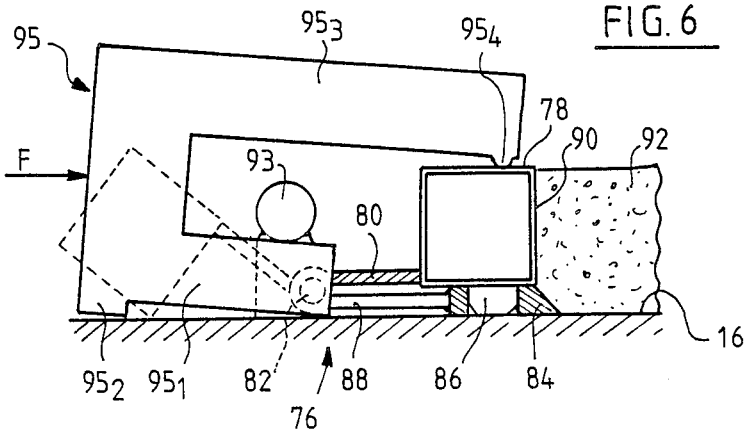
FIG. 6 is a section through an edge rule constituting a portion of the set of molds.

As shown in FIG. 6, an edge rule 76 disposed along one of the long edges 70 or 72 comprises a series of bars 78 of limited length, e.g. bars which are 3 meters long, which are disposed one after other. Each bar 78 is of square cross-section and is connected by two link arms 80 to hinges 82 placed on the outside of the long edges 70 and 72 relative to the manufacturing area. Each bar can thus be pivoted from a closure position (shown in solid lines) where one of its longitudinal faces rests horizontally on a flat chamfered bar 84, and an open position (shown in dashed lines) where the bar 78 is pivoted outwardly from the manufacturing area. The bar 84 is welded at intervals by plug welds 86 onto the metal deck constituting the manufacturing area 16. The hinges 82 are connected to the bars 84 by link rods 88.

In the closure position, the bar 78 defines a vertical face 90 which constitutes a molding wall for subsequent casting of a pre-slab 92 which will be chamfered where it meets the bar 84.

The bars 78 are pivoted between their end positions by hand.

Fastenings 93 are also provided at intervals along the two side edges of the manufacturing bench in order to anchor C-shaped locking parts suitable for locking the bars 78 against the bars 84. Each locking part 95 comprises: a branch $95_1$ fitted with a heel $95_2$ and suitable for being engaged beneath a fastening 93 and for bearing against the deck of the manufacturing 16; and a branch $95_3$ extending parallel to the branch $95_1$ and fitted with a tooth $95_4$ suitable for bearing on the top of the bar 78. The locking parts 95 are themselves locked in position by a hammer blow in the direction of arrow F.

Figure 7:
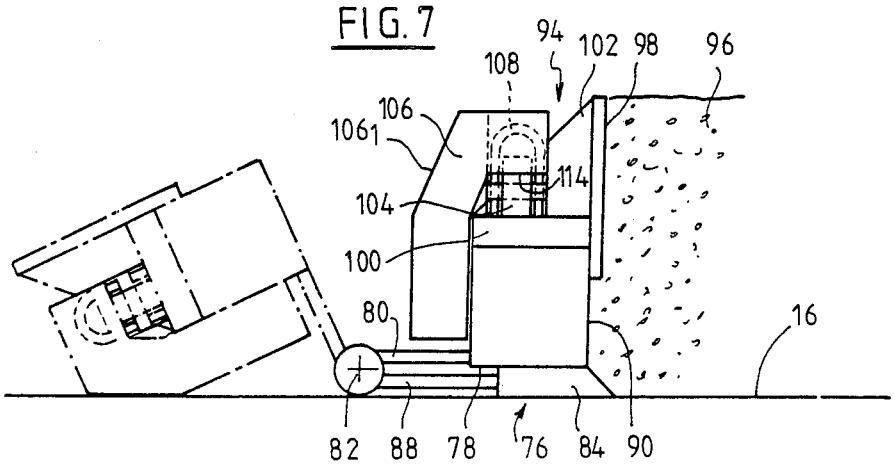
FIG. 7 is a section through an edge rule provided with a vertical extender.

In FIG. 7, the edge rule bar 78 is fitted with a removable vertical extender 94 for molding very thick elexents, in particular pre-slabs 96. This extender comprises a plate 98 which, in the closure position upwardly extends the inside face 90 of the bar 78, and partially overlaps said inside face.

Figure 8:
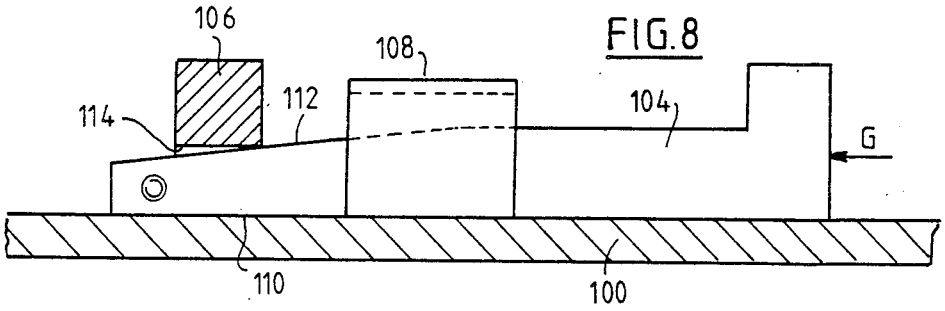
FIG. 8 is a side view of a clamping wedge locking the vertical extender of the FIG. 7 edge rule.

The plate 98 is connected to a base 100 by triangular gusset plates 102. The base 100 is suitable for being locked onto the horizontal top face of the bar 78 by means of a clamping wedge 104 which is inserted between the base 100 and a bracket 106 which is fixed to the bar 78. The wedge 104 slides inside a horseshoe 108 in the form of an upsidedown U-shaped rod whose ends are welded to the top of the base 100. The wedge 104 has a straight bottom edge 110 (see FIG. 8) suitable for resting against the top of the base 100, and a straight top edge 112 which is at a small slope relative to the bottom edge 110. The sloping top edge 112 is suitable for engaging beneath a rim 114 on the bracket 106. When a force is exerted on the end of the wedge 104, as shown by arrow G in FIG. 8, e.g., by using a hammer, the wedge clamps the vertical extension 94 to the bar 78.

It may be observed that in the open position, the bar rests on the deck of the manufacturing area 16 via a sloping portion $106_1$ of the bracket 106.

Figure 9:
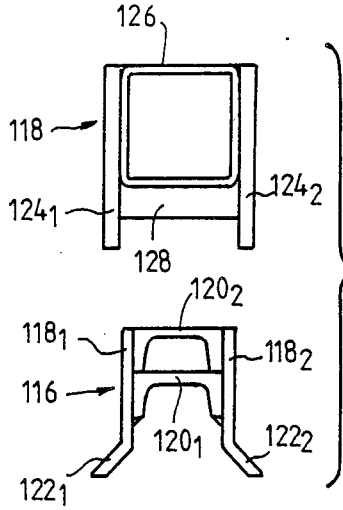
FIG. 9 is a cross-section through an intermediate rule forming a part of a molding set and provided with removable lifting means.

FIG. 9 shows an intermediate rule 116 and a removable vertical extender 118 suitable for being placed on top of said rule in order to enable thicker elements to be cast. The rule 116 may be disposed, for example, at location 66 shown in FIG. 5.

This rule comprises two parallel plates $118_1$ and $118_2$ which are interconnected by their facing faces via two superposed channel section bars $120_1$ and $120_2$. The bottom portions $122_1$ and $122_2$ respectively of said plates which come into direct contact with the deck of the manufacturing area flare outwardly in order to define a chamfer along the corners of the elements subsequently cast against said rule.

The vertical extension 118 comprises two parallel plates $124_1$ and $124_2$ which are interconnected by a square section bar 126. Spacer members 128 are disposed at intervals beneath the bar 126.

Figure 10:
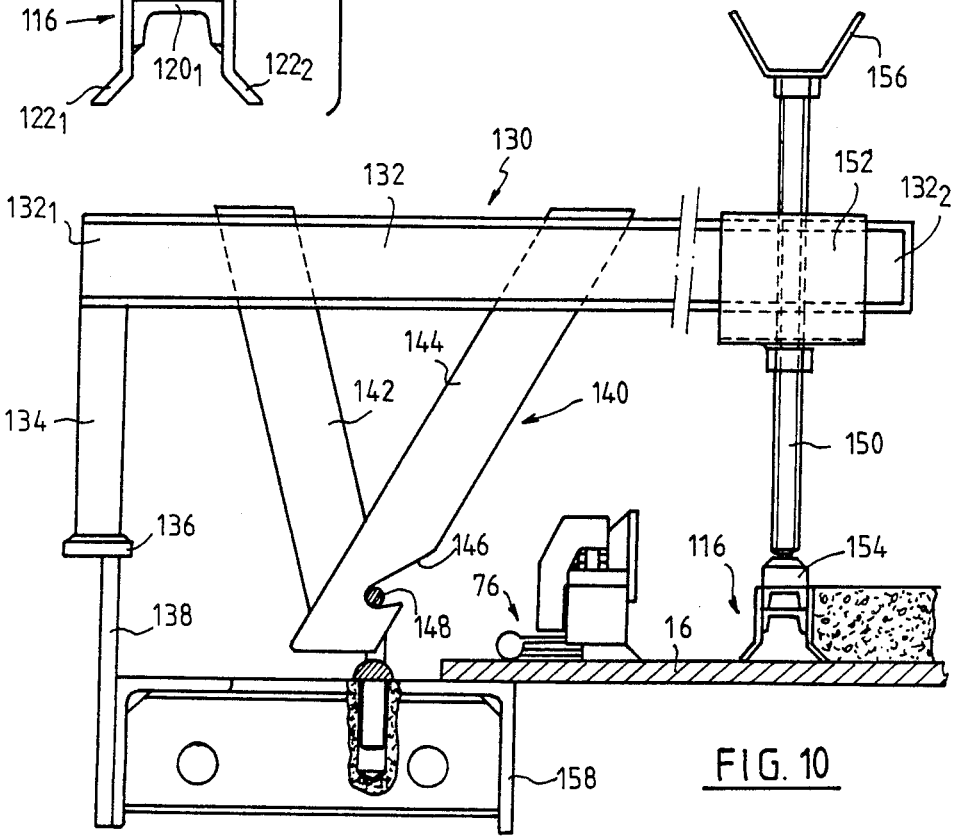
FIG. 10 is a view in partial section showing a press for holding an intermediate rule.

FIG. 10 shows a press 130 for pressing an intermediate rule 161 down against the deck of the manufacturing area 16. The press 130 comprises a crossbeam 132 extending over a portion of the width of the manufacturing area 16 and terminated at one end $132_1$ by a vertical stand 134 suitable for bearing, via a base 136, on a vertical plate 138 provided on one of the edges of the manufacturing bench. The other end $132_2$ of the crossbeam 132 is cantilevered over the manufacturing area 16.

The press 130 also includes a fastening member 140 which is fixed on the beam 132. This fastening member comprises two components 142 and 144 which are interconnected at one end to form a V-shape. The component 144 has a hook 146 suitable for anchoring in a ring 148 which constitutes one of a series of rings disposed at intervals along the bench outside the manufacturing area 16.

The press 130 also includes at least one screw jack 150 mounted on a sleeve 152 capable of sliding along the beam 132. The jack 150 is disposed vertically and has a block 154 at its bottom end for pressing down on the top of a rule 116, and has a control handle 156 at its top end.

The rings 148 are fixed to upside-down channel section beams 158 which are also used to connect each plate 138 to the deck of the manufacturing area 16.

The presses 130 are used to keep the intermediate rules 116 in desired locations, together with their vertical extenders, if used.

When a jack 150 is screwed down to press on a rule 116, the crossbeam 132 tends to rock about a pivot constituted by the hook 146 and the ring engaged therein. However, such rocking is prevented by its stand 134 pressing down on the plate 138 via the base 136.

Figure 11:
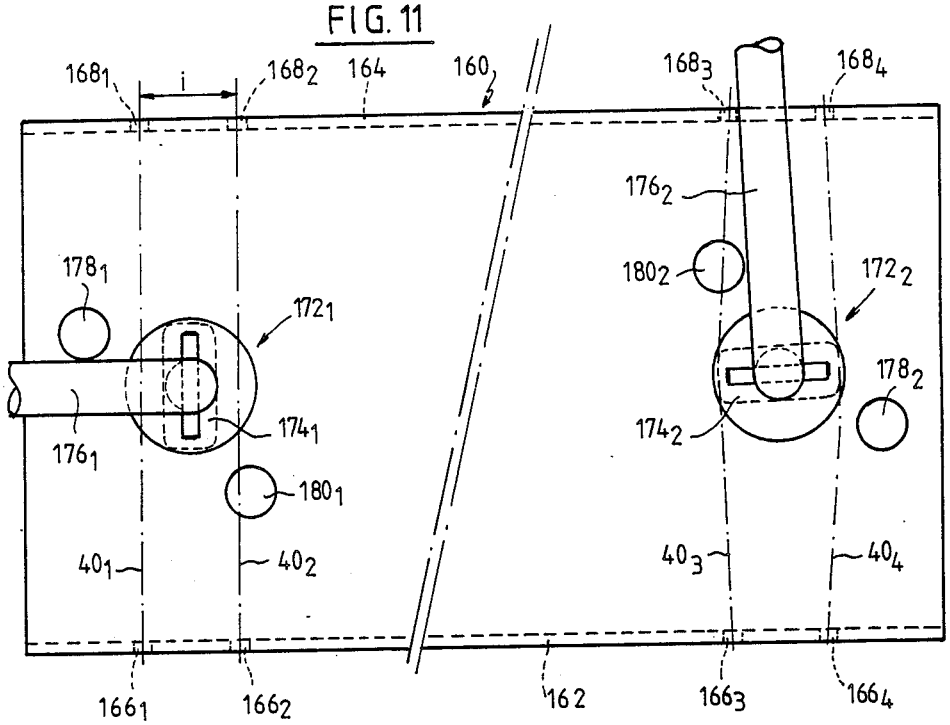
FIG. 11 is a plan view of a comb constituting a portion of a set of molds.
Figure 12:
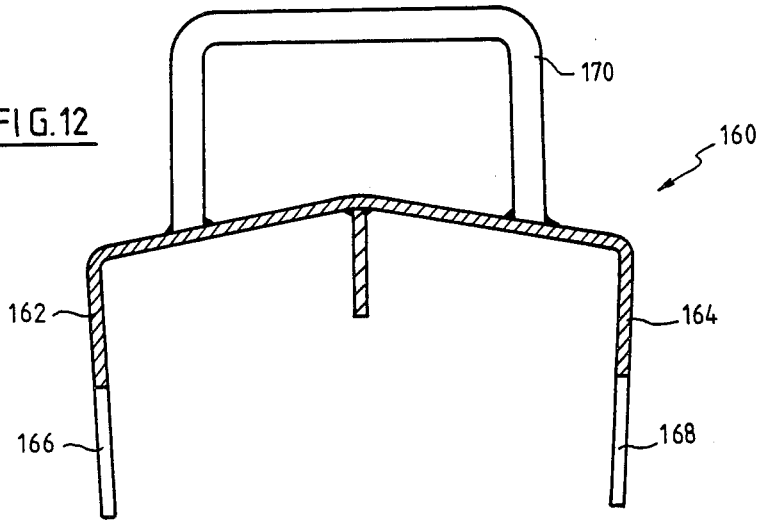
FIG. 12 is a cross-section through the FIG. 11 comb.

The comb 160 shown in FIGS. 11 and 12 constitutes a portion of the set of molds and is intended to be placed across the manufacturing area 16 at a location such as 68 shown in FIG. 5. The comb is constituted by an upside-down generally channel section bar whose flanges taper slightly towards each other in order to facilitate removal of the comb after the concrete cast on the manufacturing area has set. These flanges 162 and 164 are provided with facing vertical elongate slots, $166_1$ & $168_1$, $166_2$& $168_2$, . . . in order to receive the reinforcing wires $40_1$, $40_2$, . . . with the gap between adjacent vertical slots corresponding to the spacing i between adjacent prestress wires.

Each comb bar is fitted with two handles 170 projecting from the top of its web, for handling purposes.

Each comb further includes two locking members $172_1$ and $172_2$ which are constituted by respective eccentric or thruster members $174_1$ and $174_2$ which are rotated by respective handles $176_1$ and $176_2$. The angular displacement of each handle is limited by respective pairs of stops $178_1$ & $180_1$, and $178_2$ & $180_2$. The locking member $172_1$ is shown in its non-operative position in which the handle $176_1$ is in contact with the stop $178_1$, and the elongate member $174_1$ lies parallel to the direction of the prestress wires.

Conversely, the member $172_2$ is shown in its operative or locking position in which the handle $176_2$ is in contact with the stop $180_2$ and the elongate member $174_2$ lies substantially perpendicularly to the direction of the prestress wires. In this position it serves to thrust a pair of wires $40_3$ and $40_4$ apart.

Figure 13:
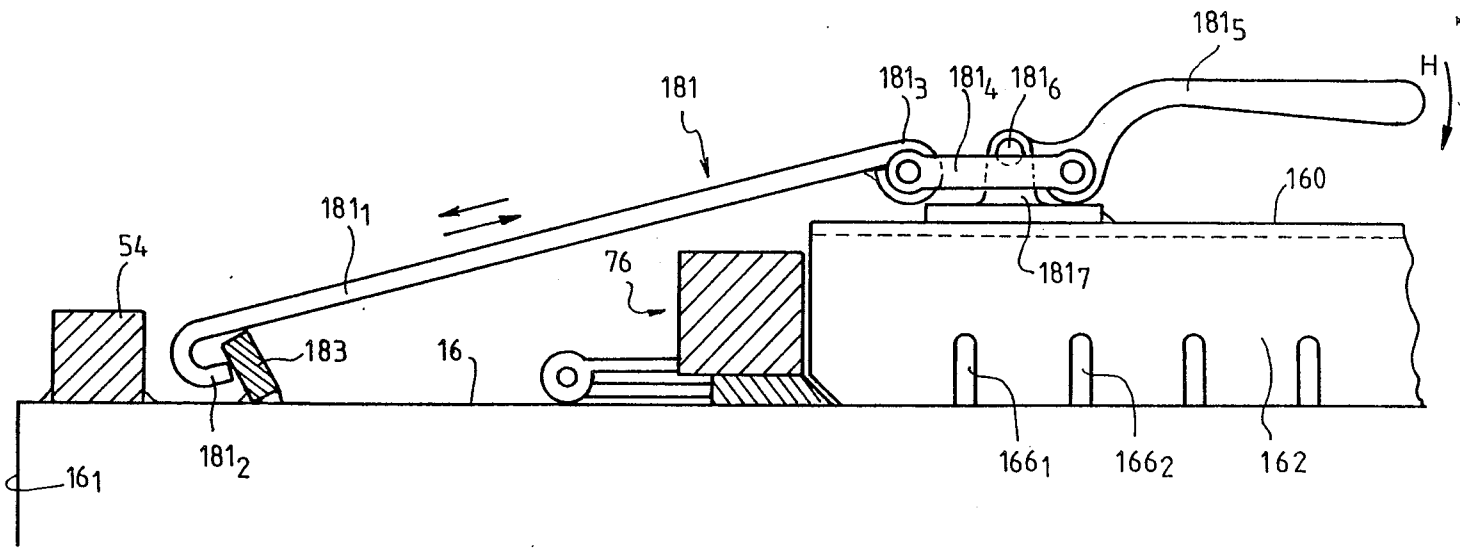
FIG. 13 is a view in partial section through a comb held by other locking means.

In a variant embodiment, shown in FIG. 13, the comb 160 is held down at each end by an assembly 181 comprising a draw-bar $181_1$ having a curved hook $181_2$ at one end suitable for latching behind an inclined flat 183. Such flats 183 are provided along the entire length of the bench and along each side thereof. The other end $181_3$ of the draw-bar is hinged on a link $181_4$ which is itself hinged to a lever $181_5$. The hinger is hinged about a shaft $181_6$ on a support $181_7$ which is fixed in turn to the top of the comb. The comb 160 is locked down by operating two levers $181_5$ (one at each end of the comb) as shown by arrow H.

Figure 14:
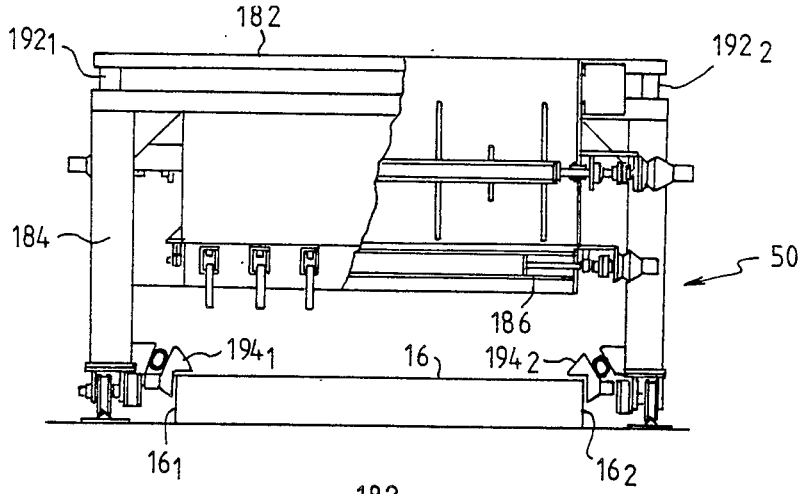
FIG. 14 is a front view of a concrete distributor-vibrator hopper.
Figure 15:
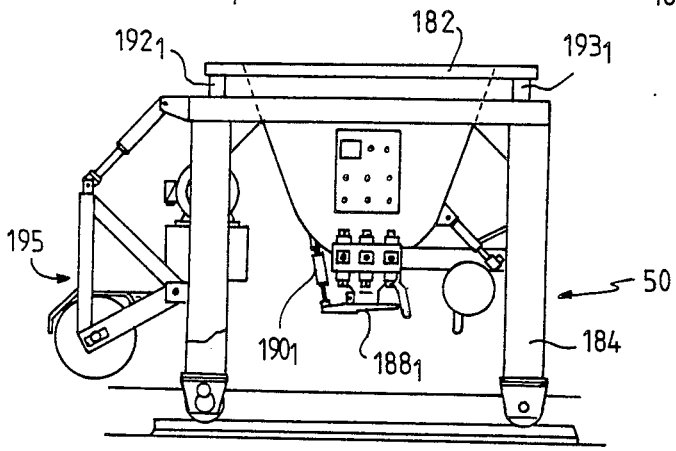
FIG. 15 is a side view of the FIG. 14 hopper.

The distributor-vibrator member 50 for distributing and vibrating the concrete is shown in FIGS. 14 and 15 and comprises a hopper 182 supported on a self-propelled carriage 184 which is displaceable along the bench. The hopper 182 has a rotary volume distributor 186 suitable for distributing concrete over the entire width of the manufacturing area, and a series of distribution flaps $188_1$, . . . independently actuated by respective actuators $190_1$, . . . in order to selectively distribute concrete over any portion of the width of the bench.

In accordance with the invention means are provided for controlling the speed of rotation of the distributor 186 and the speed of advance of the carriage 184 along the bench as a function of three sensed data items, namely:

the weight loss corresponding to the quantity of poured concrete;

the distance travelled by the self-propelled carriage during said weight loss; and the width over which concrete is being distributed.

In order to determine the weight loss corresponding to the quantity of poured concrete, the member 50 is provided with weight sensors $192_1$, $192_2$, . . . disposed between the hopper and the self-propelled carriage.

The member 50 is operationally connected to the processor unit 46 of the installation in order to take account of data relating to the items to be cast, and in particular data relating to their geometry.

The processor unit also takes account of the density of the concrete which is an input parameter that may vary from one factory to another.

Means are also provided on the chassis of the carriage 184 for vibrating the cast concrete. These means are constituted by vibrating shoes $194_1$ and $194_2$ which are connected to a vibration generator and which are suitable for pressing against the vertical edges $16_1$ and $16_2$ of the manufacturing bench.

The chassis of the carriage 184 also supports, in conventional manner, a retractable rotary brush 195 suitable for cleaning the manufacturing area, and means for spraying unmolding oil (not shown).

After the concrete has been distributed and vibrated, the top surface of the cast items must be roughened in order to facilitate subsequent adherence of a layer of concrete which will be cast thereon, on site, once the pre-fabricated pre-slab has been put into place.

Heretofore, this has been performed by a roll of expanded metal. However, such a roll cannot pass over the surface of pre-slabs if there are obstacles such as hooks, metal fittings, etc. in the way.

Figure 16:
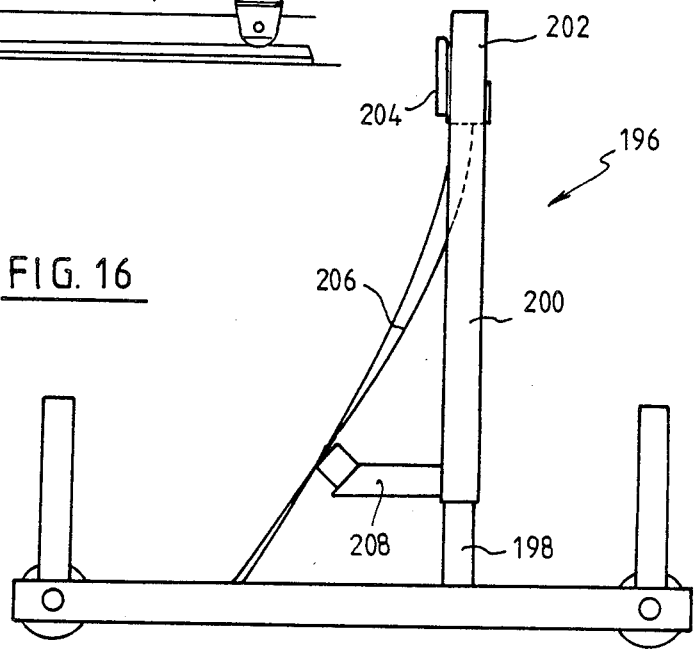
FIG. 16 is a side view of a corrugating carriage.

The present invention proposes using a corrugating carriage 196 which is displaceable along the bench, and which is shown in FIG. 16. This carriage comprises two vertical risers 198 having vertical slides 200 mounted thereon, which slides are interconnected at their top portions by a crossbeam 202. The height of the beam 202 and the slides 200 on which it is mounted is adjustable by means of a handle 204. A multiplicity of teeth 206 hang down from the beam 202 and bear against a transverse stretcher 208.

The teeth 206 are flexible and each is constituted, for example, by a length of reinforcing iron. The height of the teeth 206 is adjustable by means of handles 204 depending on the desired corrugation depth.

Figure 17:
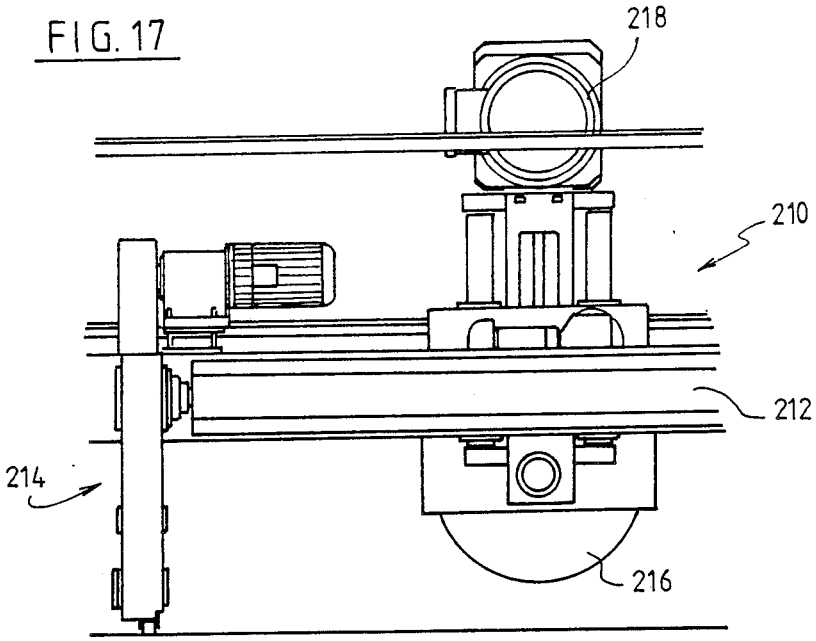
FIG. 17 is a front view of a carriage fitted with a saw for cutting the reinforcing bars.

Once the concrete has hardened and the tension has been released on the prestress wires, the wires are cut by means of an automatic cutter 210 such as shown in FIG. 17. The cutter is transversally displaceable along a beam 212 which constitutes a portion of a self-propelled carriage 214 which is itself displaceable along the bench.

The cutter 210 comprises an abrasive disk 216 which is driven by a motor 218. The cutter is also vertically displaceable, either downwardly or upwardly.

The carriage 210 includes a photoelectric detection assembly comprising an emitter E and a detector D located at a distance $\frac{1}{2}$ ahead of the disk 216, where 1 is substantially equal to the gap between two successive elements (pre-slabs) 220 and 222. This photoelectric detector assembly is suitable for causing the carriage to stop and for putting the cutter into operation whenever the assembly detects the end of a pre-slab, e.g. the pre-slab 220.

Figure 18:
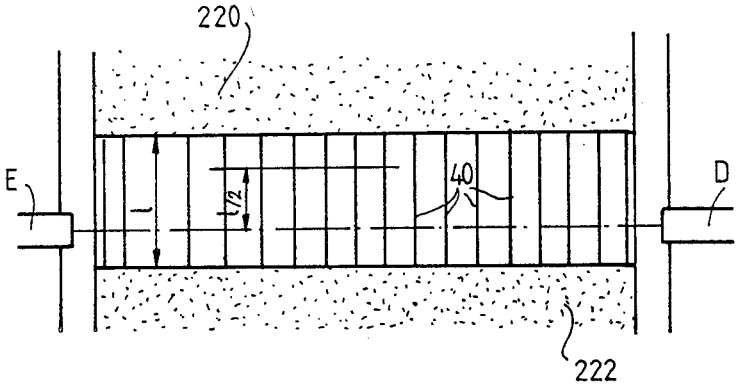
FIG. 18 is a plan view showing detector-receiver members for the FIG. 17 carriage.

Thus, the cutter serves to cut the reinforcing wires 40 along a line located substantially halfway between the pre-slabs 220 and 222 (see FIG. 18).

Figure 19:
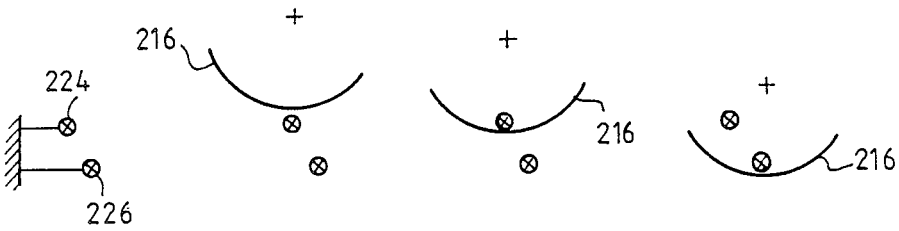
FIG. 19 is a diagram showing members for positioning the FIG. 17 saw.

As can be seen in FIG. 19, the cutter 210 further includes means for setting the cutting depth in order to take account of disk wear. These means include two detectors 224 and 226 placed at different levels above the manufacturing area 16.

These means adjust the cutter height so that the bottom portion of the disk lies between the levels of the detectors 224 and 226 respectively.

Reading from left to right, FIG. 19 shows three different situations. In the first situation, the disk 216 is too high; in the second situation the disk 216 is situated at a level lying between the two detectors; and in the last situation the disk is situated too low, i.e. at a level below both detectors 224 and 226.

Once the level of the disk has been set, the carriage 210 is placed vertically above the prestress wires 40 close to one of the edges of the bench, and then the copper saw is lowered by a constant value as measured by the number of turns of a ballscrew. Cutting can then begin.

An installation in accordance with the invention is particularly applicable to manufacturing prestressed concrete elements (in particular pre-slabs) which include insulating bottom plates.

In the prior art, an insulating plate is disposed on the manufacturing area and concrete is then cast onto the plate. This technique suffers from the major drawback of the insulation slowing down subsequent setting of the cast concrete by insulating the setting concrete from the heater means disposed beneath the manufacturing area.

The invention can be used to avoid this drawback by casting the concrete elements directly onto the manufacturing area and by subsequently applying an insulating plate to the bottom face of each item at another workstation of the installation.

Figure 20:
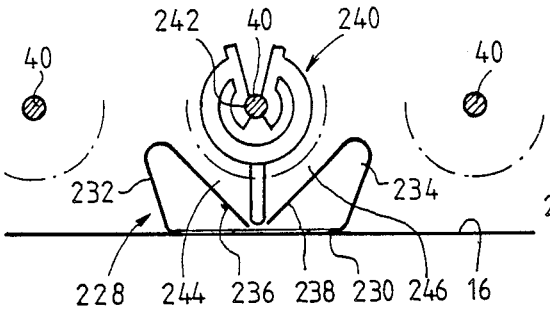
FIG. 20 shows a fastening bar being placed on the manufacturing area.

In a first variant, means are provided on the surface of the manufacturing area 16 for holding fastening bars 228 which extend along the longitudinal direction of the bench (see FIG. 20). These bars are then used subsequently for fixing an insulating plate by means of fasteners which pass through the thickness of the plate and are anchored in the longitudinal bars disposed in the bottom face, of the concrete element.

The bar 228 has a bottom wall 230 through which the fasteners are capable of passing, and which lies flat on the top surface of the manufacturing area 16. The bar further includes two side portions 232 and 234 which project upwardly and outwardly from the bottom wall 230. The side portions are then folded back towards one another to form a V-shape with a downwardly directed point. The outer flanks 236 and 238 of the V-shape are suitable for splaying apart the initially parallel arms of a fastener in the form of a staple which is force-fitted through the bottom plate.

The means for holding the bar 228 are constituted by clamps 240 which are fitted between the bar and a prestress reinforcing wire 40 (see FIG. 20). These clamps are in the form of split rings having a central opening 242 suitable for snap-fitting around a wire 40 and provided with radial projections 244 and 246 for bearing against the inside flanks of the above-mentioned V-shape.

When a pre-slab is intended to be subsequently fitted with an insulating plate, a plurality of fastening bars 228 are disposed on the manufacturing area at regular intervals and each of them is then held in place by a plurality of wedges 240.

The pre-slabs are then made as explained above.

Figure 21:
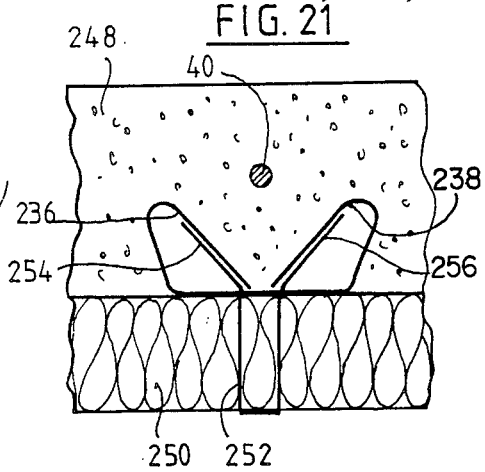
FIG. 21 shows an insulating plate being positioned on the underface of a pre-slab having at least one fastening bar buried therein as shown in FIG. 20.

The resulting pre-slab 248 is then placed on a fastening bench comprising a table which is suitable for receiving in succession an insulating plate 250 and then a concrete element 248 (see FIG. 21). The fasteners 252 are then force-fitted vertically upwardly through the plate 250 and through the bottom wall 230 of a fastener bar 228. The two arms 254 and 256 of the fastener (which is in the form of a staple) thus pass through this bottom wall and they are then deflected outwardly by the outer flanks 236 and 238 of the bar 228.

The fasteners 252 are thus held by the bar and cannot be removed therefrom by virtue of their arms being splayed apart.

After the manufacturing area 16, the installation includes a fastening bench 258 which is described with reference to FIGS. 22 to 25. The fastening bench 258 comprises a frame comprising a plurality of stands 260 which support a horizontal table constituted by five parallel bars $262_1$. . . , $262_5$, suitable for receiving in succession an insulating plate 250 and a concrete element, e.g. a pre-slab 248 coming from the manufacturing area and including fastening bars as described above.

The fastening bench 258 also includes a moving carriage 264 which is longitudinally displaceable between the stands 260 and beneath the table of the bench. The carriage 264 supports four staplers $266_1$, $266_2$, $266_3$, and $266_4$ each of which is displaceable along a corridor provided between an adjacent pair of the bars which constitute the table of the fastening bench.

The spacing between the staplers corresponds exactly to the spacing between the fastener bars which are embedded in a pre-slab 248.

These staplers are advantageously pneumatic staplers controlled from a pressure source 268 carried by the carriage 264.

As the carriage advances, the staplers insert staples 252 at intervals through the insulating plate 250, which staples are received in the various fastener bars 228 as described above with reference to FIG. 20.

In order to position an insulating plate and a pre-slab accurately on the bench, an adjustable abutment beam 270 is provided as a reference abutment. This abutment beam extends horizontally in the longitudinal direction of the table and its position is adjustable by means of a wheel 272 and of a rocking lever 274.

Figure 22:
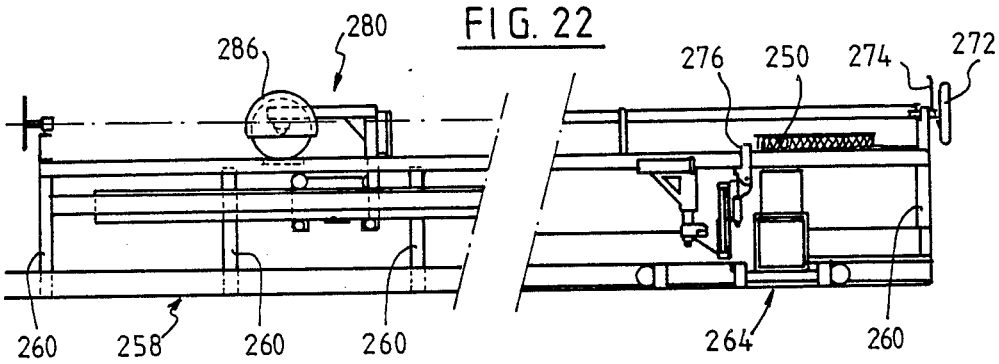
FIG. 22 is a front view of a fastening station for the installation.
Figure 23:
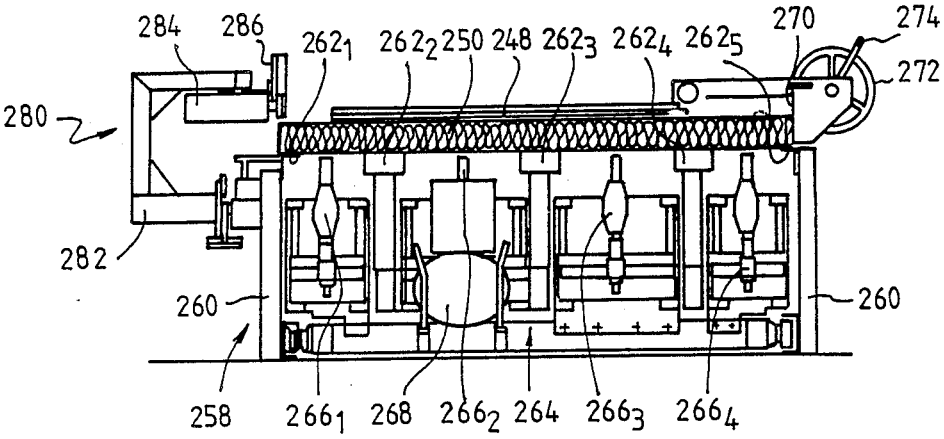
FIG. 23 is a side view of the FIG. 22 fastening station.
Figure 24:
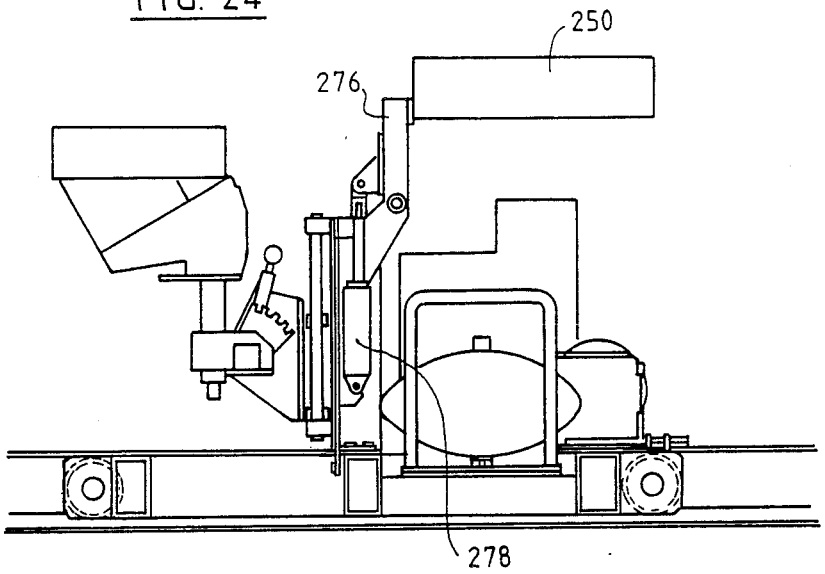
FIG. 24 shows a detail of FIG. 22.
Figure 25:
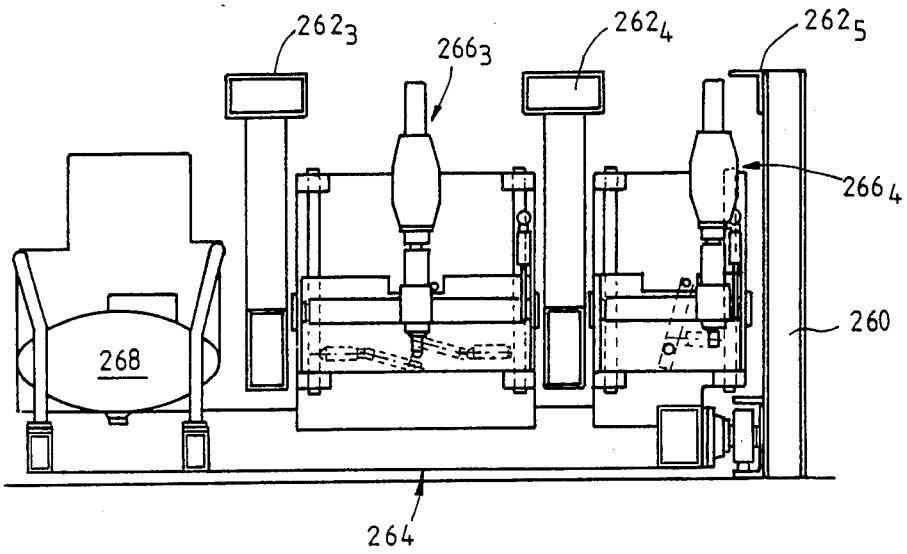
FIG. 25 shows a detail of FIG. 23.

A retractable abutment 276 is provided under the control of an actuator 278 and extends over the entire width of the fastening bench for the purpose of positioning the insulating plate 250 (see FIGS. 22 and 24).

The bench also supports a saw 280 which is longitudinally displaceable along the bench and which is suitable for cutting the insulating plate to a desired width. The saw 280 comprises a bracket 282 which is displaceable along the bench and a saw block 284 which is horizontally adjustable in position relative to the bracket. The saw block supports a circular saw 286 which is disposed vertically and which extends in the longitudinal direction of the fastening bench.

In another embodiment (not shown in the drawings) the above-described tracing means are used to mark, on a table which is generally situated immediately beyond the manufacturing bench, the contours of the concrete elements (and in particular the pre-slabs) which are to receive an insulating plate.

In order to do this, the same processor unit is used as for tracing on the manufacturing area.

Insulating plates of standard dimensions (e.g., 2.5 meters×0.5 meters) or cut to size to match the sizes of the pre-slabs are then placed on said table.

The tracing member is then driven to deposit glue in the form of a continuous fillet or in the form of spots at predetermined locations in accordance with a defined program.

By way of example, a peripheral fillet of glue may be disposed together with a fillet along each diagonal, or else peripheral spots may be disposed together with central spots.

In order to do this, the carriage 58 carrying the member 48 as shown in FIG. 4 advantageously includes a further nozzle which is specifically intended for spraying glue.

Once the glue has been deposited on the insulating plates, the pre-slabs are centered and then placed (e.g. by means of a travelling crane) onto the ready-glued insulating plates. The natural pressure due to the pre-slabs' own weight is sufficient to hold the parts together while the glue sets.

Advantageously, two glues are used in conjunction with a single pre-slab:

(a) a quick-setting glue (setting in 5 to 20 minutes, for example) in order to enable the thermally insulated pre-slabs to be handled as soon as possible; and (b) a slower-setting glue which is capable of withstanding high temperatures in order to ensure that the glue performs adequately in the event of a fire, since the insulating plate then acts as a protective member against the pre-slab collapsing prematurely during a fire.

An installation of the kind described above enables the following sequence of operations to be performed: the prestress reinforcement wires are first put into place and then put under tension; the positions of the mold walls are then traced; the vertical mold walls are then put into position, together with walls for defining any voids; concrete is distributed into the molds and vibrated; before the concrete has set, it is corrugated; the bench is heated in order to accelerate concrete setting; the tension applied to the reinforcing wires is released; the reinforcing wires are then sheared in the gaps between the cast elements; and the insulating plates are added as bottom face members, where applicable.

As mentioned above, tracing may take place before the reinforcing wires are put under tension.

Further, the central unit may also be used for stock control relating to the manufactured elements, i.e. to organize the elements as a function of each building site or each customer and to sequence the order in which the elements are used.

We claim:

1. An installation manufacturing reinforced concrete elements, said installation comprising a bench including a manufacturing area of predetermined shape together with molding apparatus defining a set of molds whose bases are formed by the manufacturing area and whose vertical contours are defined by walls placed on said manufacturing area, the installation including the improvement of:

memory means for storing building data relating to the elements to be manufactured and concerning at least the geometry thereof, said memory means storing data concerning elements which are to be manufactured together in order to fill the predetermined shape of the manufacturing area in a suitable manner;

processor control means for reading said stored data from said memory means; and tracing means controlled by said processor control means in accordance with said data for marking on the manufacturing area the locations of at least some of the walls to be placed thereon in such a manner as to completely define each mold in accordance with the corresponding data stored in the memory means.

2. An installation according to claim 1, wherein the memory means are a part of said processor control means suitable for making up a file of elements which are to be manufactured together in a single casting operation on the basis of a raw data file of elements to be manufactured.

3. An installation according to claim 1, wherein the tracing means comprise a self-propelled gantry which is displaceable over the entire length of the bench, said gantry comprising a crossbeam, a nozzle carrying carriage displaceable along said beam, a spray nozzle controlled by a valve, connected to a source of tracing liquid, and mounted on said carriage, and said processor control means being connected to the memory means and controlling displacement of the gantry and of the carriage, and also for controlling operation of the valve in accordance with said data.

4. An installation according to claim 3, wherein the processor control means is additionally programmed to trace symbols for the locations of subshapes within the molds.

5. An installation according to claim 3, wherein the tracing means are operable to project a tracing liquid via the nozzle towards the surface of the manufacturing area, said area having prestress reinforcing wires already in place.

6. An installation according to claim 1, wherein the molding apparatus comprises, in combination, edge rules constituting outside longitudinal walls of the molds, together with intermediate rules and combs being disposed in directions which are respectively longitudinal and transversal relative to the bench in locations marked by the tracing means.

7. An installation according to claim 6, further including a chamfered flat bar, wherein the edge rules comprise square section bars connected by link arms to hinges placed outside the edges of the manufacturing area for pivoting between a closure position in which one of the longitudinal faces of the edge bar rests horizontally on the chamfered flat bar is fixed to the surface of the manufacturing area, and an open position where the square section bar is pivoted away from the manufacturing area, with means being provided for locking the edge rules in the closure position.

8. An installation according to claim 7, wherein each edge bar includes a removable vertical extender for casting very thick elements, said extender including a plate which, in the closure position, extends upwardly from the inside vertical face of the squaresection bar and at least partially overlaps said inside face.

9. An installation according to claim 8, wherein the vertical extension plate is connected to a base locked to the square section bar by a clamping wedge which is inserted between the base and a bracket fixed to the square section bar.

10. An installation according to claim 6, wherein the intermediate rules each comprise two parallel plates which are interconnected via their facing faces by two superposed channel section bars, with the bottom margin of each plate intended to come into contact with the surface of the manufacturing area flaring outwardly in order to define a chamfer in the corresponding cast element, said intermediate rules further each including a removable vertical extender placed on top of the intermediate rule.

11. An installation according to claim 10, including presses for holding the intermediate rules pressed against the surface of the manufacturing area, each press comprising a crossbeam terminated at one end by a vertical stand bearing against one of the edges of the bench, a hook member which is fixed on the beam and provided with a hook being anchored in a ring which is one of a series of rings disposed at intervals along the bench on the outside of the manufacturing area, a screw jack mounted on a sleeve capable of sliding along the beam, with the screw jack being provided with a bearing block coming into contact with the top of the vertical extender.

12. An installation according to claim 6, wherein each comb comprises an upside-down generally channel section bar having two downwardly depending flanges provided with facing pairs of elongate slots for receiving prestress reinforcing wires, the bar further including at least one locking member constituted by an eccentric or thruster member actuated by a handle and suitable for bearing against two adjacent stressed wires of the prestressed reinforcement and for thrusting said wires apart.

13. An installation according to claim 6, wherein each comb is held at each end by an assembly comprising a draw-bar having one end hooking behind a flat sloping plate running along the entire length of the bench and having its other end hinged to a locking lever which is itself hinged to the comb.

14. An installation according to claim 1, wherein the molding apparatus further comprises distribution-vibrator means for feedings distributing and vibrating the concrete in the molds, said means being controlled by the processor control means.

15. An installation according to claim 14, wherein the concrete distributor-vibrator means comprise a hopper supported by a self-propelled carriage displaceable along the bench, said hopper being provided with a rotary volume distributor for distributing concrete over the entire width of the manufacturing area, and a series of distribution flaps each of which is independently operable in order to distribute concrete selectively across the width of the bench, said concrete distributor-vibrator means further including means for controlling the speed of rotation of the distributor and the speed of advance of the carriage along the bench as a function of three items of information:

weight loss corresponding to the quantity of concrete poured out;

the distance travelled by the self-propelled carriage during said weight loss; and the width over which the concrete is distributed as stored in said memory means; said carriage further including means for detecting said weight loss and said distance traveled.

16. An installation according to claim 15, wherein said means for detecting said weight loss includes weight sensors fitted between the hopper and the self-propelled carriage.

17. An installation according to claim 14, including corrugating carriage for corrugating the fresh concrete distributed by said concrete distributor-vibrator means, said carriage being displaceable along the bench and including a transverse beam of adjustable height having a multiplicity of flexible teeth depending therefrom, which teeth bear against a transverse stretcher.

18. An installation according to claim 1, including an automatic disk cutter for cutting prestressed rods between the elements obtained after the concrete elements have set, said cutter being transversely displaceable relative to a self-propelled carriage which is displaceable along the bench.

19. An installation according to claim 18, wherein the carriage includes a photoelectric detector assembly suitable for causing the carriage to stop and for putting the cutter into operation when said assembly detects where a concrete element begins, said assembly being located ahead of the cutter disk by a distance which is substantially equal to one-half of the distance between successive elements.

20. An installation according to claim 18, wherein the cutter includes means for adjusting the depth of cut, said means including two detectors placed at different levels which adjust the cutter depth so that the bottom of the disk cutter lies between the levels of the detectors.

21. An installation according to claim 1, for manufacturing prestressed concrete elements including insulating plates on their underfaces, said installation including means for maintaining longitudinal fastening bars on the bottom of the manufacturing area, which bars are subsequently used for fixing insulating plates by fastening means passing through the thickness of the plates and anchoring in said bars.

22. An installation according to claim 21, wherein the means for holding the fastening bars are wedges inserted between each fastening bar and a corresponding prestress reinforcing wire, and said prestress reinforcing wire extends longitudinally along the bench with at least a portion of said wires substantially vertically aligned with the fastening bars.

23. An installation according to claim 21, wherein the installation includes a fastening bench located adjacent to the manufacturing area, said fastening bench comprising a table receiving in succession an insulating plate and a concrete element including fastening bars from the manfacturing area, said fastening bench further including a plurality of fastener drivers which are longitudinally displaceable beneath and table in order to insert fasteners at intervals through the insulating plate and into each of the fastening bars.

24. An installation according to claim 1, for manufacturing prestressed concrete elements including insulating plates on their undersides, wherein the tracing means are further for tracing the contour of a selected concrete element on a table situated beyond the manufacturing bench, and further including means for placing glue at a pre-selected locations on an insulating plate placed on said table in accordance with said contour, and lifting means for transferring the concrete elements from said table to said manufacturing bench.

* * * * *